US005079562A

United States Patent [19]

Yarsunas et al.

[11] Patent Number: 5,079,562

[45] Date of Patent: Jan. 7, 1992

[54] MULTIBAND ANTENNA

[75] Inventors: George D. Yarsunas, Vincentown; Michael L. Brennan, Howell, both of N.J.; James R. Hendershot, Arroyo Grande, Calif.

[73] Assignee: Radio Frequency Systems, Inc., Marlboro, N.J.

[21] Appl. No.: 547,993

[22] Filed: Jul. 3, 1990

[51] Int. Cl.[5] ..... H01Q 1/10; H01Q 9/18

[52] U.S. Cl. ..... 343/792; 343/715; 343/903

[58] Field of Search ..... 343/790–792, 343/901, 903, 715, 860, 862, 864

[56] References Cited

U.S. PATENT DOCUMENTS

| | | | |
|---|---|---|---|
| 3,576,578 | 4/1971 | Harper | 343/792 |
| 4,095,229 | 6/1978 | Elliott | 343/715 |
| 4,325,069 | 4/1982 | Hills | 343/750 |
| 4,647,941 | 3/1987 | Myer | 343/792 |
| 4,658,260 | 4/1987 | Myer | 343/792 |
| 4,675,687 | 6/1987 | Elliott | 343/715 |
| 4,721,965 | 1/1988 | Elliott | 343/715 |
| 4,748,450 | 5/1988 | Hines et al. | 343/820 |
| 4,847,629 | 7/1989 | Shimazaki | 343/901 |

OTHER PUBLICATIONS

*Antenna Engineering Handbook*, ed. H. Jasik, McGraw-Hill Book Co., 1961, Chap. 22, p. 22-5, FIG. 22-4.

*Primary Examiner*—Michael C. Wimer

*Attorney, Agent, or Firm*—Peter C. Van Der Sluys

[57] ABSTRACT

A multi-band antenna is adapted to receive signals in the AM/FM bands and to receive and transmit signals in a significantly higher frequency band such as that used for cellular telephone. An AM/FM band antenna is formed of a tubular rod, and a higher frequency band antenna is formed using a centerfed coaxial dipole mounted on top of and coaxially with the AM/FM antenna. The dipole is fed by a coaxial rod attached to a coaxial cable extending through the AM/FM antenna. A cylindrical choke is disposed about the coaxial rod and is spaced a predetermined distance from the dipole antenna to reduce coupling between the AM/FM antenna and the high-frequency antenna. The choke functions to position the input impedance of the high-frequency antenna at the base of the choke in a manner so that a short matching transformer may be used at the base of the choke for connection to the coaxial cable. In matching the antenna in this manner at the base of the choke, the best possible VSWR characteristics of the antenna are preserved and the radiation pattern of the antenna's main lobe extends horizontally along a horizontal axis.

12 Claims, 6 Drawing Sheets

| STIMULUS FREQ MHz | CH1 S11 VSWR |
|---|---|
| 824.000 000 | 1.1799 |
| 826.880 000 | 1.2025 |
| 829.760 000 | 1.2352 |
| 832.640 000 | 1.2709 |
| 835.520 000 | 1.2985 |
| 838.400 000 | 1.3158 |
| 841.280 000 | 1.314 |
| 844.160 000 | 1.3042 |
| 847.040 000 | 1.2822 |
| 849.920 000 | 1.2571 |
| 852.800 000 | 1.2295 |
| 855.680 000 | 1.1976 |
| 858.560 000 | 1.1735 |
| 861.440 000 | 1.1548 |
| 864.320 000 | 1.1558 |
| 867.200 000 | 1.174 |
| 870.000 000 | 1.21 |
| 872.960 000 | 1.2601 |
| 875.840 000 | 1.3058 |
| 878.720 000 | 1.3397 |
| 881.600 000 | 1.3586 |
| 884.480 000 | 1.367 |
| 887.360 000 | 1.3653 |
| 890.240 000 | 1.353 |
| 893.120 000 | 1.3364 |
| 896.000 000 | 1.3087 |

MULTIBAND ANTENNA

BACKGROUND OF THE INVENTION

1. Field of the Invention

The present invention relates to vehicular antennas and more particularly to antennas adapted to receive AM/FM radio signals and to receive and transmit higher-frequency signals, such as cellular telephone signals.

2. Description of the Prior Art

Cellular telephone service is becoming exceedingly popular and is very much in demand. Since cellular telephones operate in a frequency band considerably higher than the normal AM/FM radio, separate cellular telephone antennas must be installed on vehicles. Initially the existence of the cellular antenna on a vehicle was a status symbol but it is now considered a pretentious display that is to be avoided by those in the service industry. Automobile owners dislike the unsightly objects extending from their vehicles and the need for multiple feed cable holes in the vehicle's exterior for body mounted antennas. In addition, cellular telephones are common targets for thieves, and the cellular antenna is literally a flag directing potential thieves to the desired vehicles.

It is desirable to retract a radio antenna into the body of the vehicle so as to leave the vehicle's lines clean and streamline when the radio is not in use. Retractable antennas are also desirable since the antennas, if they are not retractable, are commonly damaged when the vehicle passes through a car wash. Electrically powered mechanisms for retracting AM/FM radio antennas have become quite common on most modern vehicles. The same feature would be extremely desirable for a cellular telephone antenna.

It is also desirable to provide a single multiband antenna which can handle both the AM/FM commercial broadcast frequencies and the cellular telephone frequencies. Multiband antennas have been provided for use with CB radios as illustrated in U.S. Pat. Nos. 4,095,229 and 4,325,069. Such antennas may be coupled through a single feed line to a splitter to separate the AM/FM and CB radio frequencies. In other situations, a loading coil is provided on the antenna itself to produce an effective length suitable for transmission and reception of the desired frequency band.

Retractable triband antennas for the AM/FM bands and the cellular telephone band are disclosed in U.S. Pat. Nos. 4,647,941; 4,658,260; 4,675,687; 4,721,965; 4,748,450 and 4,847,629.

The numerous devices of the prior art provide triband antennas for AM/FM reception and cellular telephone service; however, in general the prior art antennas exhibit a high VSWR, poor isolation between the cellular and AM/FM antenna portions, a radiation pattern off the horizontal axis, poor impedance and pattern bandwidth.

SUMMARY OF THE INVENTION

The present invention contemplates a multiband antenna comprising a typical AM/FM tubular antenna terminating at its distal end with a center-fed coaxial dipole antenna for the cellular band. The feedline for the cellular antenna extends through the tubular AM/FM antenna.

In a first embodiment, the antenna is telescoping, with two lower members forming the AM/FM antenna and the uppermost member forming the cellular antenna. The feedline for the cellular antenna also serves to couple mechanical extension and retraction forces to the telescoping sections of the antenna. A second embodiment contemplates a rigid antenna fixed in a radome which can be removed for car washing.

The dipole antenna comprises a whip portion extending upwardly from a connection to the feedline, and a coaxial skirt extending downwardly from the feedline connection. A second coaxial skirt is disposed about the feedline and has an upper end located at a specific distance from the skirt of the dipole antenna and a lower end located near the top of the AM/FM antenna. The second skirt forms a choke, which results in negligible coupling to the AM/FM antenna and positions the input impedance of the cellular antenna at the base of the choke in a precise manner so that a short matching transformer may also be used. In matching the antenna in this manner at the base of the choke, the best possible VSWR characteristics of the antenna are preserved and the radiation pattern of the antenna's main lobe extends horizontally along a horizontal axis.

A primary objective of the present invention is to provide a triband antenna for AM/FM radio and cellular telephone bands.

Another objective of the present invention is to provide a triband antenna having a cellular antenna that exhibits a very low broadband VSWR.

Another objective of the present invention is to provide a triband antenna that has a cellular portion that exhibits a radiation pattern that is on the horizontal axis over a broad range of frequencies.

Another objective of the present invention is to provide a triband antenna wherein there is minimal coupling between the cellular portion and the AM/FM antenna portion.

DETAILED DESCRIPTION OF THE INVENTION

Figure 1:
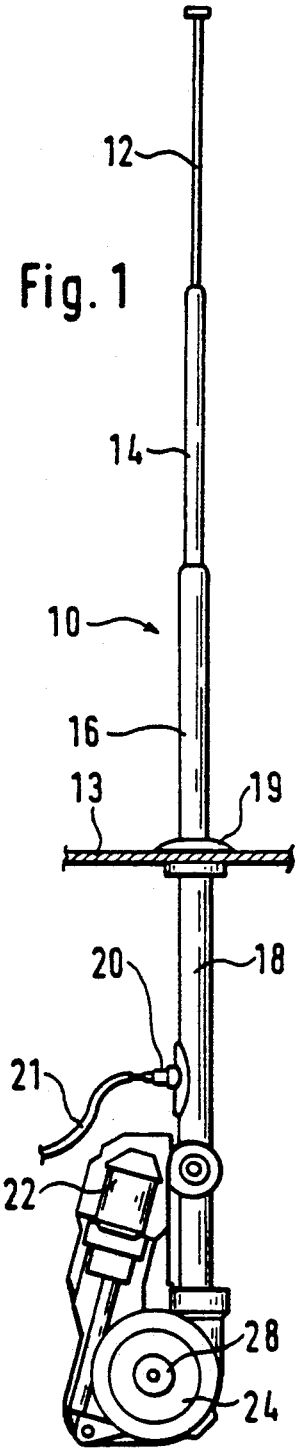
FIG. 1 is a front view of an extended telescoping antenna constructed in accordance with the present invention.

FIG. 1 illustrates a telescoping collapsible triband antenna 10 including three coaxially arranged sections 12, 14 and 16 forming an antenna mast which may be retracted into a base section 18 which is typically mounted beneath the surface of a vehicle. Mounting apparatus 19 is provided on the top of section 18 for mounting the antenna to a vehicle surface 13. A stud 20 is provided for coupling sections 14 and 16 to a suitable AM/FM band radio receiver via a cable 21. An electric motor 22 such as a twelve-volt DC motor is provided for actuating a reel or spool mechanism provided in a housing 24 to extend or retract a coaxial cable 26 shown in FIG. 2. The coaxial cable 26 extends through base section 18 and sections 14 and 16 of the AM/FM antenna and is connected to antenna section 12 which forms a cellular telephone antenna. The cable 26 transfers mechanical forces for extending and retracting the antenna sections and is driven by motor 22 through the reel provided in housing 24. A coaxial stud or connector 28 is mounted on the axis of rotation of the reel in housing 24 and is connected within the reel to cable 26.

Additional details of the structure of the reel and cable drive mechanism may be found in U.S. Pat. Nos. 4,647,941 and 4,658,260.

Figure 2:
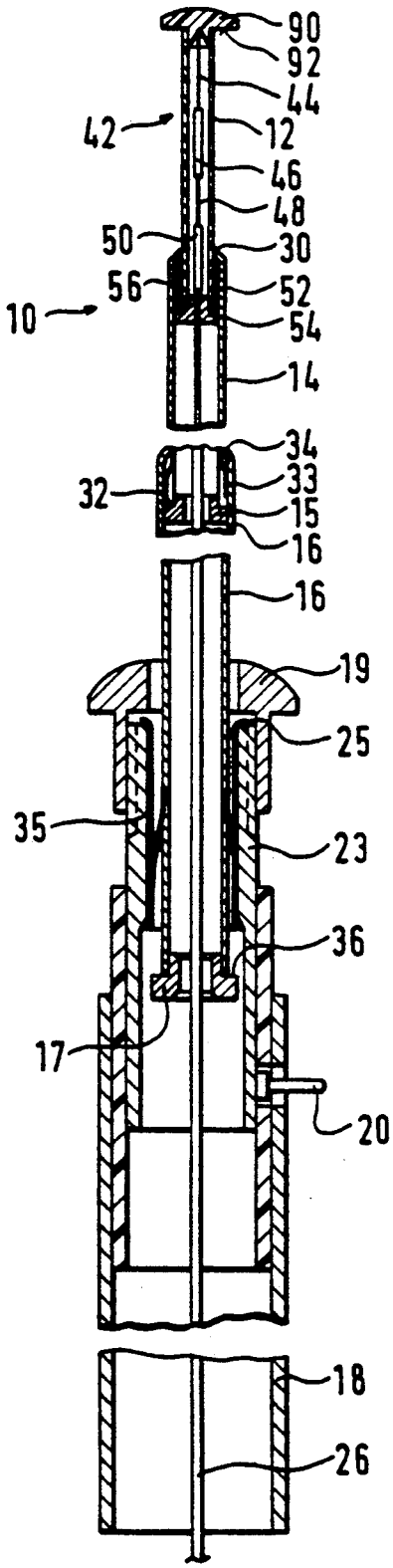
FIG. 2 is a vertical section of the antenna portion of the telescoping antenna of FIG. 1.

Referring to FIG. 2, there is shown a collapsible telescoping antenna 10 having the three telescopingly arranged sections 12, 14 and 16 forming the antenna mast. Sections 14 and 16 are preferably formed of brass or stainless steel tubes which may be plated on the exterior surface for ornamental and corrosion-resistance purposes. Both sections 14 and 16 have their upper ends rolled inwardly and their lower ends terminated by shouldered bushings 15 and 17 respectively. Bushings 15 and 17 function to guide sections 14 and 16 and form an interference fit and stop the travel of the telescoping members when the antenna is fully retracted. The upper end of section 14 is rolled inwardly at 30 and at the lower end bushing 15 has a shoulder 32. Section 16 is rolled inwardly at 34 and bushing 17 has a shoulder 36. Alignment spring sleeves 33 and 35 are disposed about sections 14 and 16 adjacent bushings 15 and 17 respectively. The spring sleeves 33 and 35 function to center the sections coaxially and also to make electrical contact from section 14 to section 16 and from section 16 to a conductive sleeve 23 mounted inside of base section 18, which is in contact with the stud 20.

When the antenna is being extended, the spring sleeve 33 engages section 16 at 34 and spring sleeve 35 engages a shoulder 25 that is part of mounting apparatus 19 to limit the upwardly travel of sections 14 and 16. When the antenna is being retracted, adaptor 54 engages bushing 15, which further engages bushing 17 to retract the antenna sections. Button 90 eventually engages mounting apparatus 19 to stop the antenna travel.

Section 12 is formed of a fiberglass material and functions as a radome in which the cellular antenna portion is mounted. The cellular antenna, which will subsequently be described in greater detail, comprises the center-fed half-wave dipole antenna 42 consisting of a whip portion 44 and a coaxial skirt 46. The dipole is fed by a 50-ohm micro-coax feed line rod 48 which extends upwardly through the skirt 46 of the dipole antenna. A coaxial choke 50 is formed at the base of the dipole antenna coaxially with and surrounding the micro-coax feed line rod 48. The feedline rod 48 is terminated at the base of the dipole antenna by a transformer 52 and an insulated radome adapter 54 which is slidably fitted inside section 14. A spring alignment sleeve 56 is disposed about the radome and extends outwardly from the surface thereof to engage section 14. Alignment sleeve 56 assures that the fiberglass radome is centered within section 14 and is coaxial therewith. Sleeve 56 is not for electrical contact, since the radome is fiberglass.

At the transformer 52 and the adapter 54, the micro-coax feed line rod 48 is electrically connected to cable 26 through the transformer 52 for feeding the cellular signals to the cellular antenna. In addition, as previously discussed, cable 26 functions to transfer the mechanical forces for extending and retracting the antenna sections of the collapsible antenna.

Figure 3A:
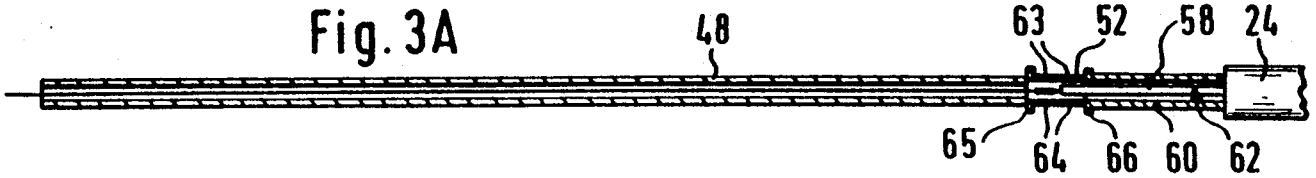
FIGS. 3A, 3B and 3C are partial sections showing the construction of a cellular antenna portion of the triband antenna of the present invention.
Figure 3B:
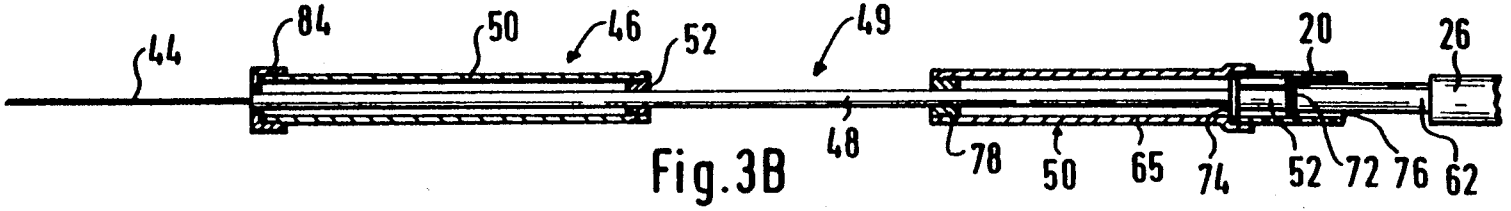
Figure 3C:
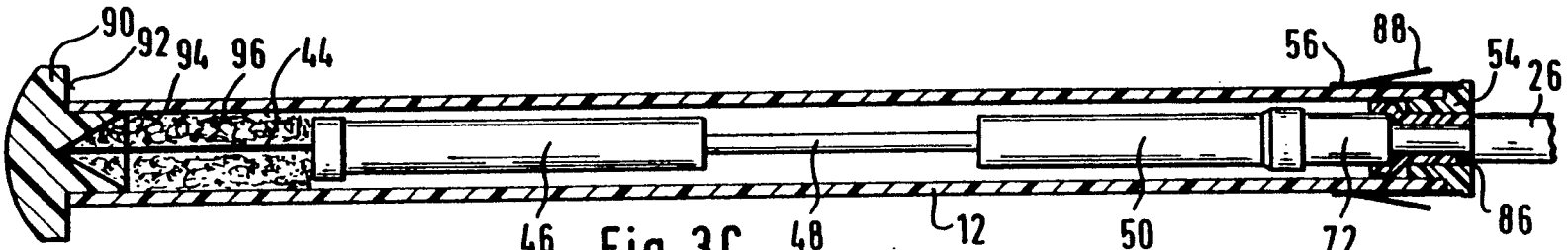

Referring to FIGS. 3A, 3B and 3C, there is shown in detail the construction of the cellular antenna portion provided in section 12. Referring specifically to FIG. 3A, there is shown coaxial cable 26 which may be a standard RG-400 coaxial cable feed line having a stranded center conductor 58 surrounded by a dielectric 60 and a braided outer conductor 62. A portion of the cable jacket is stripped, as is a portion of the braided outer conductor and dielectric layer, so as to expose axial lengths of the center conductor 58 and the braided outer conductor 62, which exposed portions are preferably pre-tinned.

A matching transformer 52 has axial openings 63 formed in each end thereof and radial openings 64 intersecting with the axial openings. A larger one of the axial openings is adapted to receive the exposed portion of the center conductor 58, which exposed portion extends through a disc-shaped spacer 66 formed of insulating material such as Teflon. The center conductor 58 is soldered to the transformer 52 through the radial opening 64.

The matching transformer 52 is essentially a cylindrical conductor sized specifically to the frequencies handled by the antenna. For cellular signals, the nominal size should be 0.126 inch O.D. and 0.430 inch long. The O.D. can vary from 0.065 to 0.175 inch, with the length varying from 3.5 to 0.062 inch respectively. However, antenna operation degrades rapidly as the. size shifts away from nominal.

A length of 50-ohm micro-coax feed line rod 48 has its outer conductor and insulation layer stripped back for a distance of approximately 0.150 inches at each end, leaving a length of microcoax of 7.75 inches. The micro-coax is a standard, general-purpose 50-ohm semi-rigid coaxial cable, such as micro-coax Part No. UT47 provided by Micro-Coax Components, Inc., of Collegeville, Pa. The diameter of the outer conductor is 0.047 inch, while the diameter of the center conductor is 0.0113 inch. An exposed portion of one end of the center conductor of the micro-coax 48 is inserted through an insulating spacer 68 and into an axial opening of transformer 52 and is soldered thereto through one of the radial openings 64.

Referring specifically to FIG. 3B, an axially-split insulator sleeve 70 is spread and installed over the transformer 52, and a metallic transformer sleeve 72 is slipped over the transformer and extends over an axial length of the braided outer conductor 62. The transformer sleeve 72 is soldered to the outer conductor of the micro-coax 48 at 74 and is soldered to the braided outer conductor 62 at 76.

The choke 50 is formed by a cylindrical member 64 axially disposed over the micro-coax 48. Cylindrical member 64 has a widened end portion extending over the transformer sleeve 72 and is soldered thereto to make electrical contact with the transformer sleeve and the outer conductors of the micro-coax 48 and the cable 26. The other end of cylindrical member 64 is coaxially spaced with the micro-coax 48 through the use of an insulating spacer 78 and is secured thereto by the formation of a plurality of dimples in the cylindrical member, thereby locking the spacer in place.

A cylindrical member 80 is coaxially disposed over the distal end of micro-coax 48 and forms the skirt 46 of the dipole antenna 42. The cylindrical member 80 is maintained in a coaxial position with micro-coax 48 through the use of an insulating spacer 82, which is held in place by the formation of a plurality of dimples in the cylindrical member 80. At the distal end of the micro-coax 48 and the skirt 46, a metallic cup 84 is disposed for positioning the cylindrical member 80 coaxially with the micro-coax 48. The cup 84 is soldered to both the outer conductor of micro-coax 48 and to the cylindrical member 80 to make electrical contact therewith.

A whip portion 44 of the dipole antenna is formed from 22-gauge magnet wire which is enamel coated. At one end the enamel coating is stripped from the magnet wire and is soldered to the center conductor of the micro-coax 48.

For proper operation of the cellular antenna, the various dimensions of the antenna components are critical to obtain the desired antenna characteristics. The whip portion 44 of the antenna is nominally 0.250λ, but after soldering is cut to a length of 2.70 inches from the upper surface of the cup 84. The total length of the skirt 46 of the dipole antenna is 0.250λ, as is the length of the choke 50 measured from its most distal end to the position of the transformer 52. A critical dimension is that of the exposed portion 49 micro-coax 48 between the skirt 46 and the choke 50. This dimension should be 0.086λand should be held within a tolerance of one percent λ i.e.±0.01λ.

For purposes on this invention, the cellular frequency range is 824–894 MHz, with a center frequency of 859 Mhz having a wavelength in air of 13.74 inches.

In a final stage of production, the cellular portion of the antenna is constructed as shown in FIG. 3C. A length of heat-shrink insulating tubing 86 is positioned over a lower portion of transformer sleeve 72 and over the exposed portion of the outer conductor 62 and is shrunk into place by the application of heat. A coating of epoxy adhesive is applied to the outer surface of the shrink tubing 86, and a radome adapter 54 is slid into place over the shrink tubing. The cylindrical fiberglass radome 12 is slid over the antenna assembly onto and against a shoulder formed on the radome adapter 54 and is joined thereto using an adhesive such as Loctite Prism Series 410 Adhesive. The spring alignment sleeve 56 is then slid over the radome 12 into position against a second shoulder formed on the radome adapter 54. The spring sleeve 56 includes a number of outwardly extending arms 88 which are adapted to resiliently engage the inner surface of the section 14, as shown in FIG. 2. The spring alignment sleeve 56 functions to center section 12 of the antenna and maintain it in a coaxial orientation with sections 14 and 16.

Finally, a button 90 is mounted in the distal end of the radome 12 and is secured with an adhesive such as Loctite Prism Series 410 Adhesive. The button 90 includes an outwardly extending shoulder 92 having a sufficient diameter so as to cover the upper ends of sections 14 and 16 when the antenna is retracted and to engage bushing 25 and form a seal therewith. The lower portion of button 90 is formed with an inwardly extending conical surface 94 which functions to partially align whip 44 concentrically within the radome 12 and to prevent excessive movement of the antenna assembly within the radome.

It may be desirable to partially fill the interior of the radome with a foam material as shown at 96 to assist in damping any vibrations of the antenna assembly.

The assembled cellular antenna portion found in section 12 is thus arranged to operate as a high-frequency, center-fed half-wave dipole antenna, particularly adapted for use in a cellular telephone band centered about approximately 859 MHz. A dipole antenna of this general type is described in "Antenna Engineering Handbook", edited by H. Jasik, McGraw-Hill Book Company, 1961, at pages 22-2 through 22-14.

Through the unique use of the 50-ohm micro-coax 48, the cellular antenna may be constructed with a small enough diameter to be fit into radome 12 and be used in a telescoping antenna as the uppermost element without requiring the antenna to have an extensively large diameter. The Applicants have discovered that by positioning the sleeve 46 of the dipole antenna 0.086λfrom the top of the choke 50, the coupling between the cellular antenna and the AM/FM antenna is significantly reduced as the micro-coax 48 becomes non-radiating in this area. This unique positioning also results in a substantially horizontal radiation pattern over a broad range of frequencies. The spacing also results in the positioning of the input impedance of the cellular antenna at the base of the choke in a precise manner such that a short matching transformer may be used. By employing the short matching transformer directly beneath the choke, a very low broadband VSWR is achieved.

Figures 4A, 4B:
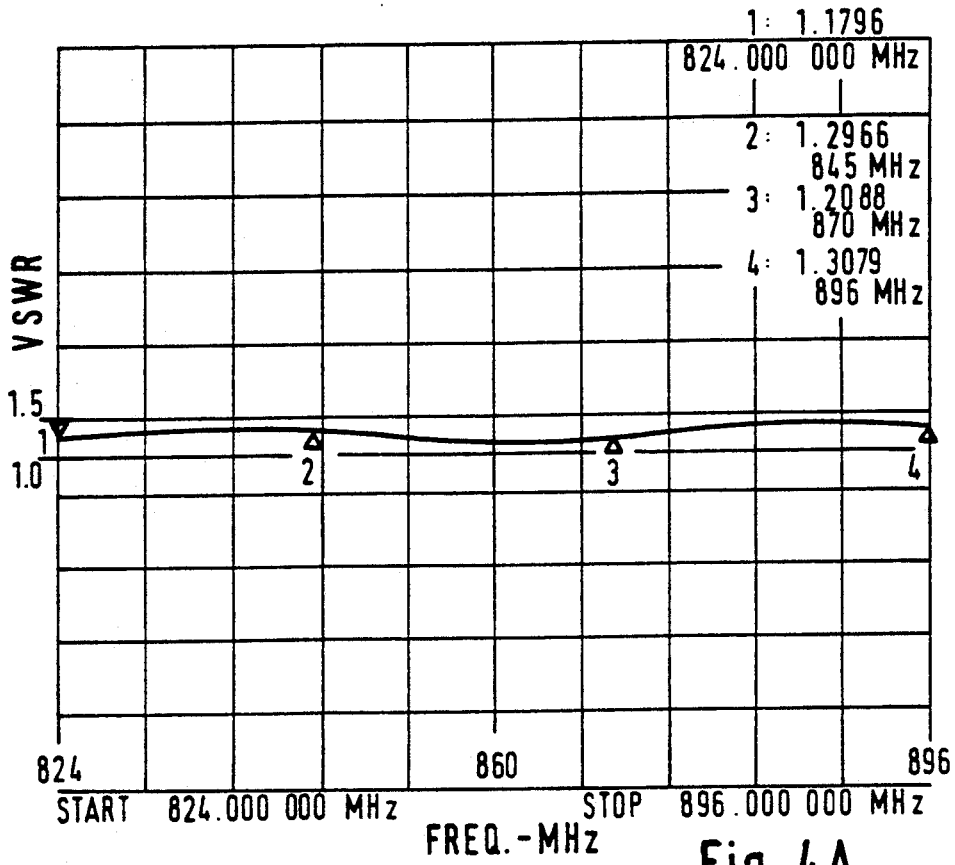
FIGS. 4A and 4B are respectively a graph and a table illustrating the low broadband VSWR achieved by the antenna of the present invention.

Referring to FIGS. 4A and 4B, there is shown test results illustrating the VSWR achieved over a frequency range of 824 MHz to 894 MHz, with the VSWR being significantly below 1.5.

Figure 5B:
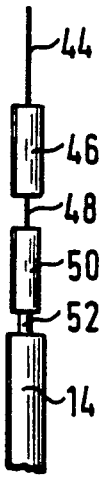
FIG. 5A is a plot of measured E-plane patterns for various cellular choke and AM/FM antenna spacings as illustrated schematically in FIGS. 5B, 5C and 5D.
Figure 5C:
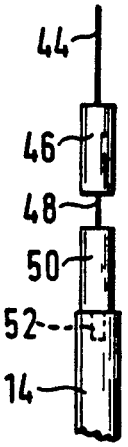
Figure 5D:
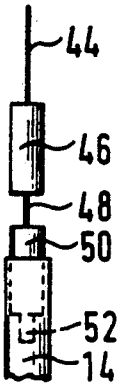
Figure 5A:
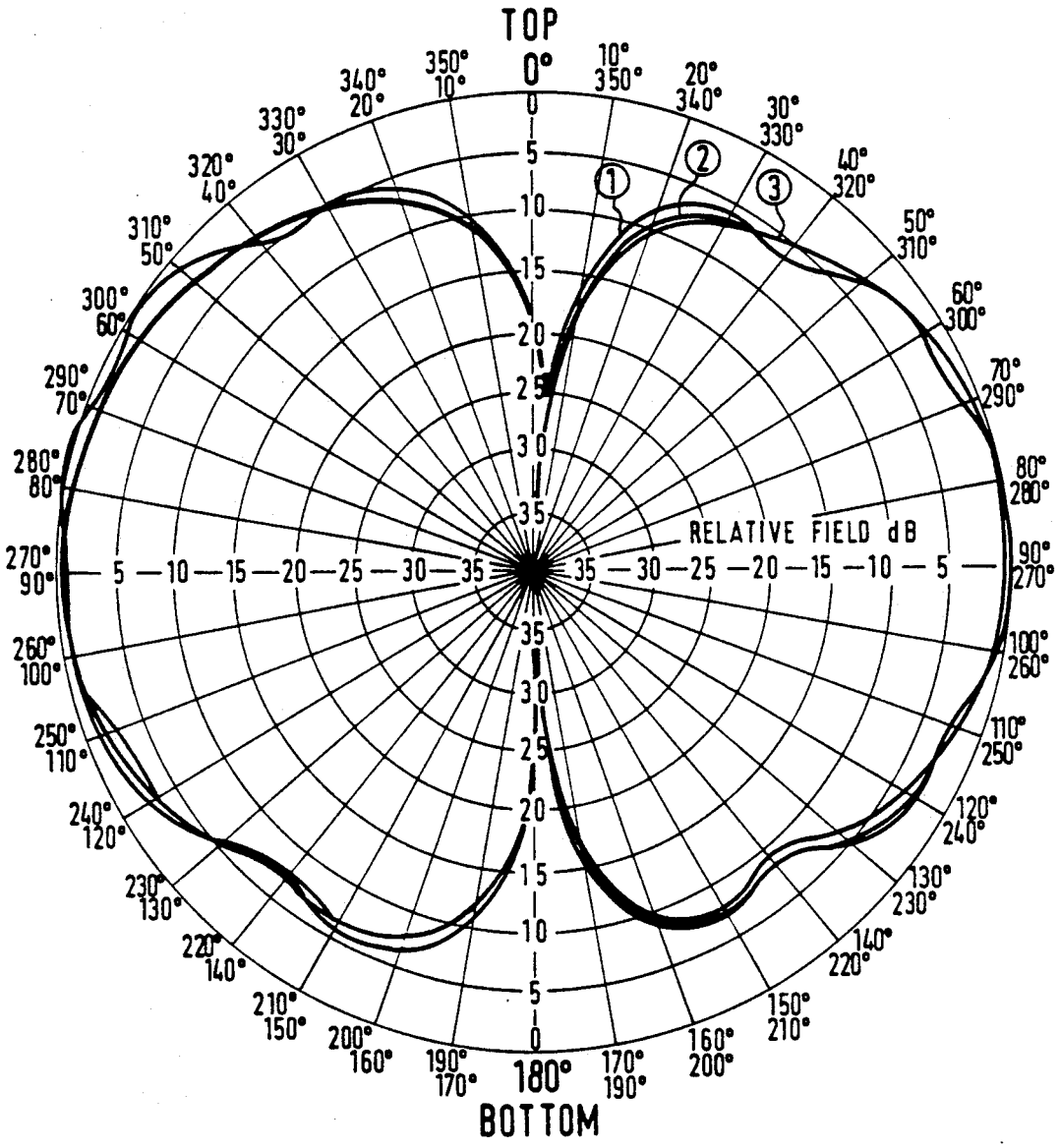

Referring to FIGS. 5A, 5B, 5C and 5D, there is shown the radiation pattern for the horizontal main lobe for three relative positions of the choke versus the AM/FM antenna portion. Plots 1, 2 and 3 shown in FIG. 5A correspond to the relative positions illustrated in FIGS. 5B, 5C and 5D respectively. In FIG. 5B, the choke 50 and transformer 52 are shown positioned outside of the AM/FM antenna portion. In FIG. 5C, the transformer 52 is located just within the AM/FM antenna. In FIG. 5D, the choke 50 is substantially extended into the AM/FM antenna portion. As illustrated in FIG. 5A, the horizontal lobe provides a desirable radiation pattern for all positions so that the overall length of the antenna may be reduced.

Figure 6:
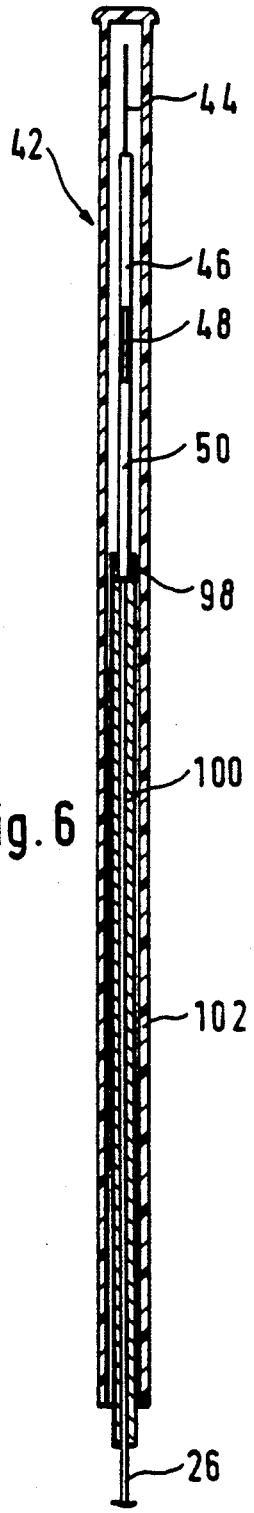
FIG. 6 shows a schematic illustration of a rigid, non-collapsible triband antenna constructed in accordance with the teachings of the present invention.

The present invention also contemplates a rigid embodiment of the triband antenna. This embodiment may be detachably mounted to a vehicle for removal when the vehicle is in an unsafe area or when the vehicle is to go through a carwash. The rigid embodiment is shown in FIG. 6, which is shown with corresponding elements marked with the same numerical indicia as the elements in the collapsible antenna shown in FIG. 2.

The cellular antenna assembly as shown in FIG. 3B is attached to the cable 26 in a manner similar to that shown in FIG. 3B and heat-shrink tubing is disposed about the bare braided outer conductor 62. A coaxial insulating element 98 is disposed about the transformer sleeve 72, the shrink tubing 86 and the outer jacket of cable 26 for a short axial distance, with said insulating element 98 being disposed within a length of brass tubing 100. The brass tubing 100 forms an AM/FM antenna section. The combined cellular antenna assembly and the AM/FM antenna portion are thereafter disposed within a cylindrical fiberglass radome 102.

Figure 7:
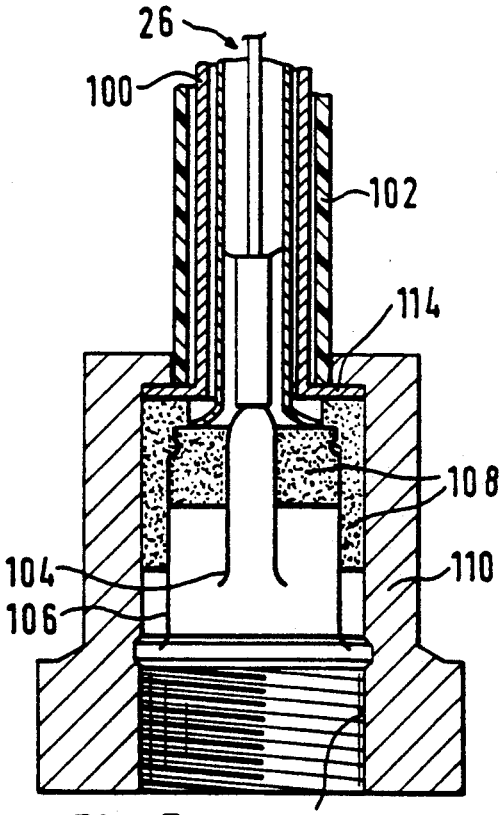
FIG. 7 is a vertical section of a female connector for the antenna of FIG. 6.
Figure 8:
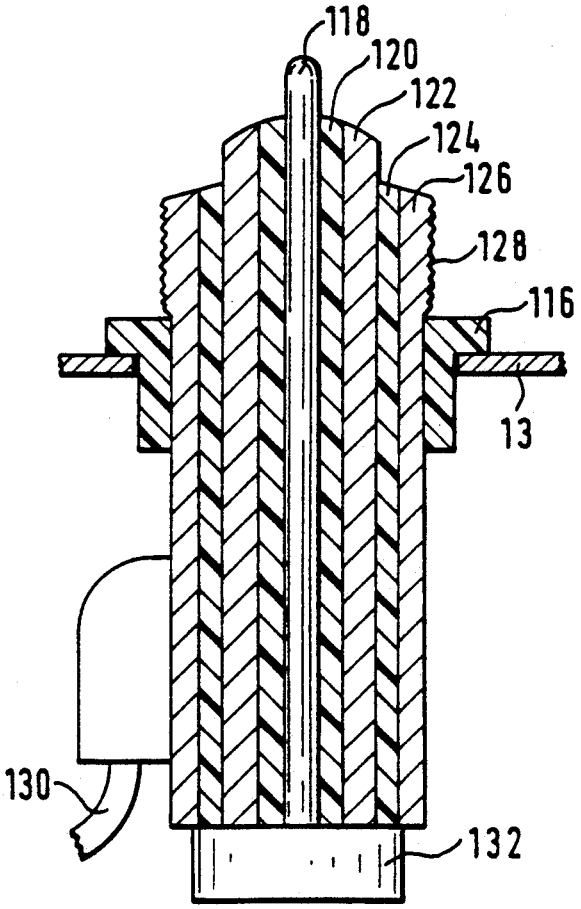
FIG. 8 is a partial section of a male connector for the antenna of FIG. 6.

It is contemplated that the rigid antenna structure may be mounted to a vehicle using a tri-axial connector having female and male components, as illustrated in FIGS. 7 and 8 respectively.

Referring to FIG. 7, there is shown two coaxially-mounted cup fittings 104 and 106 mounted in dielectric material 108, which functions to properly space and align the cup fittings. The center conductor of cable 26 is electrically coupled to the cup fitting 104, while the outer conductor of cable 26 is electrically connected to the cup fitting 106. A hex or knurled nut 110 is formed in the shape of a cup and includes inside threads 112 for connection to a complementary male coupler. The AM/FM antenna portion 100 terminates in an outwardly extending flange 114, which is engaged beneath the nut 110 to make electrical contact therewith. The fiberglass radome 102 is adhesively connected within an opening in the nut 110.

Referring to FIG. 8, there is shown the complementary male connector portion for the connector shown in FIG. 7, said connector having an insulated mounting member 116 for mounting the connector in a hole formed in a vehicle's body. The connector comprises a plurality of concentric layers formed about a center conductor 118 terminating in an extending tip for connection to the cup fitting 104. An insulating layer 120 surrounds conductor 118 and is further surrounded by a cylindrical conductor 122 which has an exposed cylindrical surface for contact with the cup fitting 106. Conductor 122 is surrounded by insulating material 124, about which is disposed a cylindrical layer of conductive material 126. The cylindrical conductor 126 has a threaded external portion 128 which becomes threadably engaged with the internal threads 112 of the nut 110 when the antenna is mounted to the vehicle.

An AM/FM feed line 130 is connected to the outer cylindrical conductor 126 for conveying the AM/FM band signals to an AM/FM receiver. The conductors 118 and 122 are connected to a coaxial cable stub 132 so that a 50-ohm coax cable can be connected thereto for providing the cellular band signals to the cellular telephone.

Thus, the present invention provides two embodiments of a triband antenna capable of receiving signals in the AM/FM commercial radio bands and receiving and transmitting cellular telephone signals. The antenna exhibits a very low broadband VSWR while having a radiation pattern on the horizontal axis. Minimal coupling is experienced between the cellular and AM/FM antenna portions.

What is claimed is:

1. An antenna, comprising:, a center-fed coaxial dipole having first and second elements for radiating and receiving electromagnetic energy in a frequency band, said first and second elements each having a length equal to approximately one-quarter wavelength of a frequency at approximately the mid-range of said frequency band, said first element being a whip and the second element a conductive cylindrical sleeve coaxially aligned with said whip;

a coaxial conductor rod having inner and outer conductors and being axially aligned with the dipole and extending through the second element of the dipole, the inner conductor of the conductor rod being electrically connected to the whip and the outer conductor being electrically connected to the cylindrical sleeve; and a coaxial choke formed of a cylindrical sleeve of electrically conductive material being disposed about and coaxial with the coaxial conductor rod, said choke having a length equal to approximately one-quarter wavelength of the frequency at approximately the mid-range of said frequency band, an end of said choke remote from the dipole being connected to the outer conductor of the conductor rod, and an end of the choke nearest to the dipole being spaced from the second element of the dipole by a distance equal to approximately 0.086 wavelength of the frequency at approximately the mid-range of said frequency band.

2. An antenna as described in claim 1, additionally comprising a matching transformer axially aligned with the coaxial conductor rod and connected to the inner conductor of the coaxial conductor rod at a location proximate to the end of the choke remote from the dipole.

3. An antenna as described in claim 2, additionally comprising a coaxial cable having inner and outer conductors, the inner conductor being connected to said matching transformer and the outer conductor being connected to the outer conductor of the coaxial conductor rod and the choke.

4. An antenna as described in claim 1, additionally comprising an antenna portion mounted axially with the dipole and insulated therefrom, said antenna portion for receiving electromagnetic energy in a frequency band substantially lower than the frequency band of the dipole.

5. An antenna as described in claim 4, wherein the antenna portion receives AM/FM signals.

6. An antenna as described in claim 5, wherein the dipole radiates and receives cellular telephone signals.

7. An antenna as described in claim 4, wherein the antenna portion is formed of a hollow tubular conductive material and is disposed axially with the dipole, said antenna additionally comprising:

a matching transformer axially aligned with the coaxial conductor rod and connected to the inner conductor of the coaxial conductor rod at a location proximate to the end of the choke remote from the dipole; and a coaxial cable having inner and outer conductors, said coaxial cable extending through the antenna portion and having its inner conductor connected to the matching transformer and its outer conductor connected to the outer conductor of the coaxial conductor rod and the choke.

8. An antenna as described in claim 7, wherein the dipole, coaxial conductor rod and choke form a high-frequency antenna portion having dimensions which allow it to be telescopingly received within the antenna portion, with said coaxial cable providing extending and retracting forces to the high-frequency antenna portion.

9. An antenna as described in claim 8, wherein the high-frequency antenna portion is mounted within a cylindrical radome structure.

10. An antenna as described in claim 9, wherein the antenna portion is formed of telescoping members, at least one of said members also being extended and retracted by forces exerted by the coaxial cable on the high-frequency antenna portion.

11. An antenna as described in claim 10, additionally comprising:

reel means for storing the coaxial cable when said antenna is retracted; and means for driving said reel means to cause said coaxial cable to extend and retract.

12. An antenna as described in claim 7, wherein the dipole, coaxial conductor rod and choke form a high-frequency antenna portion, said antenna additionally comprising:

a rigid cylindrical radome in which said high-frequency antenna portion and the antenna portion are disposed; and connector means disposed at a base of the radome for connecting the antenna portion to a source of signals in the lower frequency band of the antenna portion and for connecting the coaxial cable to a source of signals in the frequency band of the dipole.

* * * * *